US005107552A

United States Patent [19]

Lavallière et al.

[11] Patent Number: 5,107,552

[45] Date of Patent: Apr. 28, 1992

[54] SWIMMING POOL COVER AND ROLL-UP DEVICE

[75] Inventors: Jean Lavallière, St-Jean-Baptiste; Michel Dallaire, Montreal, both of Canada

[73] Assignee: Vogue Industries, Ltd., LaSalle, Canada

[21] Appl. No.: 520,268

[22] Filed: May 3, 1990

[51] Int. Cl.[5] ..... E04H 4/00

[52] U.S. Cl. ..... 4/502; 4/498

[58] Field of Search ..... 4/502, 498, 503, 496, 4/499, 500, 504, 426, 494, 506, 488; 126/415, 416, 417, 426; 242/73, 68.5, 86.52

[56] References Cited

U.S. PATENT DOCUMENTS

| | | | |
|---|---|---|---|
| 3,050,074 | 8/1962 | Miller | 135/1 |
| 3,659,305 | 5/1972 | Powers | 15/104.061 |
| 3,777,319 | 12/1973 | Myles | 4/172.14 |
| 3,952,758 | 4/1976 | Addison et al. | 135/5 |
| 4,328,930 | 5/1982 | Kalendousky | 4/498 |
| 4,385,407 | 5/1983 | Zook | 4/498 |
| 5,004,177 | 4/1991 | Sômers | 242/99 |

OTHER PUBLICATIONS

Solar Roller Brochure printed Oct. 17, 1989.

4 advrtrmnts–rcvd. Oct. 9, 1990–". . . Solar Roller . . . "; over the name of David Huff, Owner and distributed by Solar Factory Pool Products, 1011 Mason St., Vacaville, CA 95688.

*Primary Examiner*—Henry J. Recla
*Assistant Examiner*—David J. Walczak
*Attorney, Agent, or Firm*—Samuel Meerkreebs

[57] ABSTRACT

A swimming pool cover and roll-up device combination comprising a flexible shaft extending intermediate of the swimming pool cover from one edge to an opposite edge, with the flexible shaft being connected at least intermittently along its length to the swimming pool cover. A crank arm or other wind-up device is provided to be connected at least to one end of the flexible shaft for applying torque to the flexible shaft. The flexible shaft can transmit the torque through the length thereof to roll up the swimming pool cover on the flexible shaft. The flexible shaft and swimming pool cover are adapted to float on the surface of the water, and when it is necessary to store the rolled-up swimming pool cover, it is removed completely from the swimming pool and stored remote therefrom.

8 Claims, 3 Drawing Sheets

SWIMMING POOL COVER AND ROLL-UP DEVICE

BACKGROUND OF THE INVENTION

1. Field of the Invention

The present invention relates to swimming pool covers, and more particularly to a device for winding up and storing such a cover.

2. Description of the Prior Art

Swimming pool covers are an advantageous accessory for outdoor swimming pools. They are placed on the surface of the water when the swimming pool is not in use for the purpose of insulating the top surface of the water in order to reduce heat loss, particularly at night. A pool cover also reduces the amount of evaporation of the water in the pool and the chemicals in solution therewith, such as chlorine. Accordingly, such swimming pool covers contribute to lowering the cost of operating a swimming pool.

Such covers are usually made of a laminated flexible plastic sheet material with pockets trapping air therein and are at least 4 meters in diameter or square in order to cover all of the surface of the water on the swimming pool. It is not always practical, particularly with larger pool, to roll up the cover by hand and simply place it on the side of the pool. Accordingly, a roll-up device for a swimming pool cover is preferably used.

In many cases, the roll-up device is simply a length of aluminum pipe on which the cover is wrapped at an edge and then two persons, one at each end of the pipe, cause the pipe to be rotated, thus rolling up the cover.

Such roll-up devices may include a rigid shaft supported at each end on a pair of posts or brackets. The rigid shaft is spaced above the water surface at one end of the pool if it is a rectilinear pool or oval, and tangential to an above-ground circular pool. An example of such a wind-up device is shown in U.S. Pat. No. 3,777,319, Myles, Dec. 11, 1973. FIG. 3 in this patent shows a typical installation with the wind-up device located at one end of an inground pool.

Such roll-up devices are relatively unsightly and can be an obstruction since access to the pool is prevented from whichever end the device is installed. On above-ground pools, the latter may be less of a problem. However, given that above-ground pools are generally circular, it is almost a necessity that the roll-up device extend diametrically of the pool that is directly over the center. The alternative is to handle the cover manually and remove it on or off the water surface as best one can. Such a solution becomes impractical on larger pool sizes.

SUMMARY OF THE INVENTION

It is an aim of the present invention to provide a roll-up apparatus for a swimming pool cover which overcomes the above-mentioned problems and which can be utilized with either below-ground or above-ground pools.

It is also an aim of the present invention to provide a roll-up device and pool cover combination which can be removed completely from the pool and stored in an unobtrusive manner.

It is a further aim of the present invention to provide a roll-up device which is simple and inexpensive to manufacture.

A construction in accordance with the present invention includes a roll-up device for a swimming pool cover. The roll-up device comprises an elongated flexible shaft which is adapted to be attached at least at intermittent locations along its length to a floatable sheet material cover which substantially covers the water surface of a swimming pool. The shaft when attached to the cover can float on the water surface and the flexible shaft can transmit torque to the cover through the entire length of the shaft. Winding means are provided for applying torque to at least one end of the shaft in order to roll the flexible cover on the shaft.

In a more specific embodiment, the flexible shaft is attached to the sheet material cover intermediate the cover, laterally from one edge to an opposite edge thereof.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
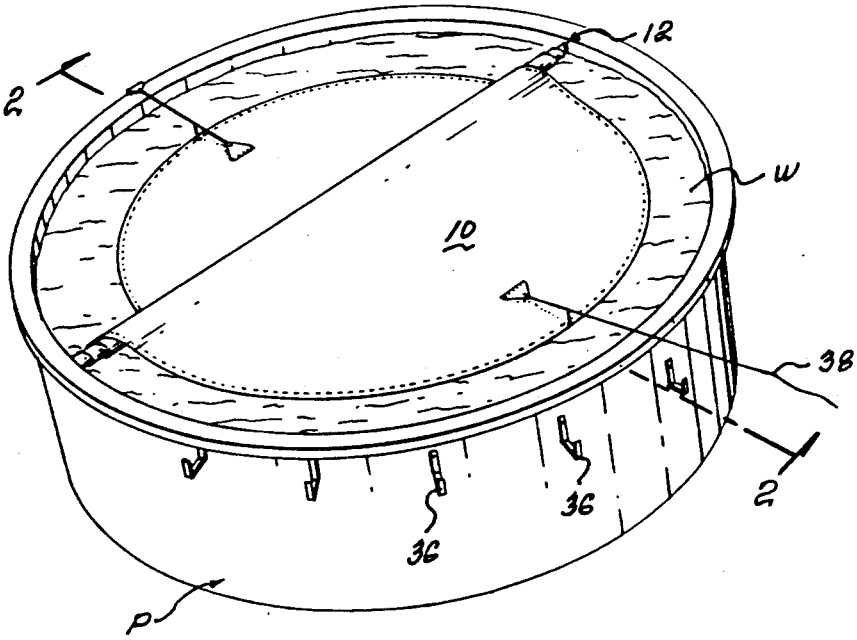
FIG. 1 is a perspective view of a swimming pool with a swimming pool cover of the present invention partially laid out over the water surface.
Figure 2:
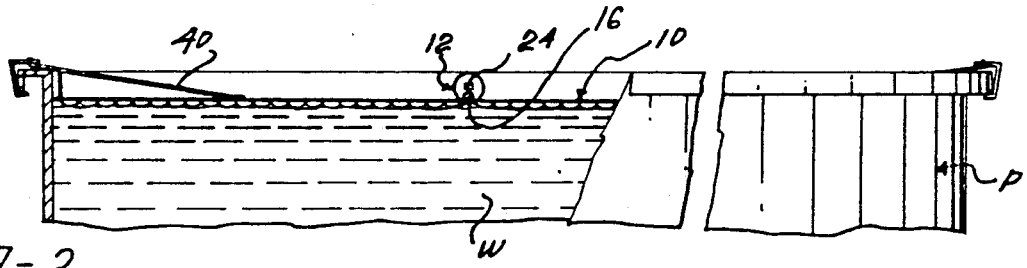
FIG. 2 is a fragmentary side elevation, partially in cross-section.
Figure 3:
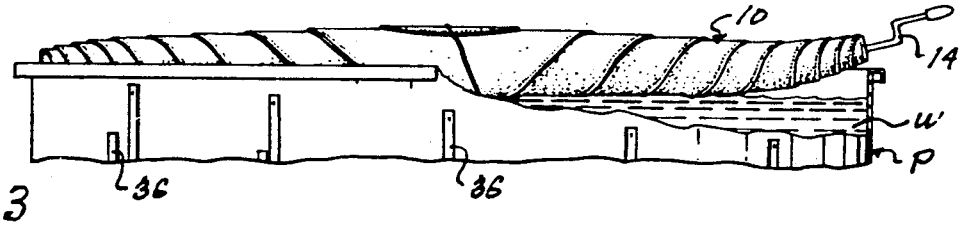
FIG. 3 is a fragmentary side elevation, partially in cross-section, showing the swimming pool cover rolled up.
Figure 4:
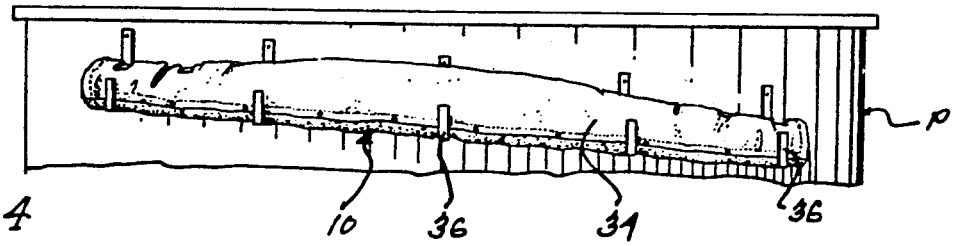
FIG. 4 is a fragmentary side elevation showing the swimming pool cover in a stored position.
Figure 5:
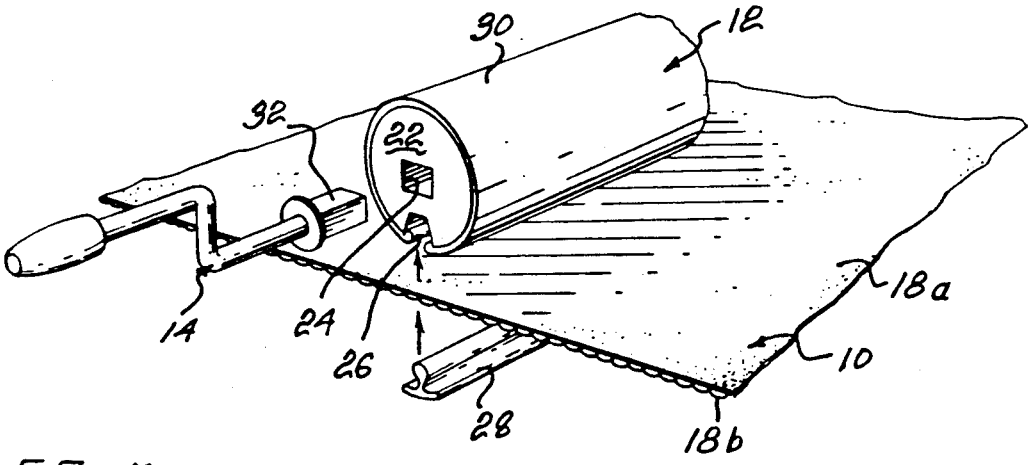
FIG. 5 is a fragmentary exploded perspective view of a detail thereof.

Referring now to the drawings, there is shown in FIGS. 1, 2 and 5, a swimming pool cover 10 to which a flexible shaft 12 is attached along its length by means of fasteners 16. The shaft 12 extends along the diameter of the circular swimming pool cover in this embodiment. When the swimming pool cover 10 is fully deployed on the surface of water W, of what is shown as an above-ground swimming pool P, the flexible shaft 12 remains attached to and across the laminated sheet 18 of the cover 10. The shaft 12 is either light weight enough, so as not to cause the cover 10 to sink in the area of the shaft 12, or is itself constructed so to leave buoyancy.

In order to roll up the swimming pool cover 10, a crank arm 14 is inserted into one end of the flexible shaft 12, and it is rotated to transmit the torque through the entire length of the flexible shaft in order to roll up the laminated sheet 18 onto the shaft 12.

Figure 6:
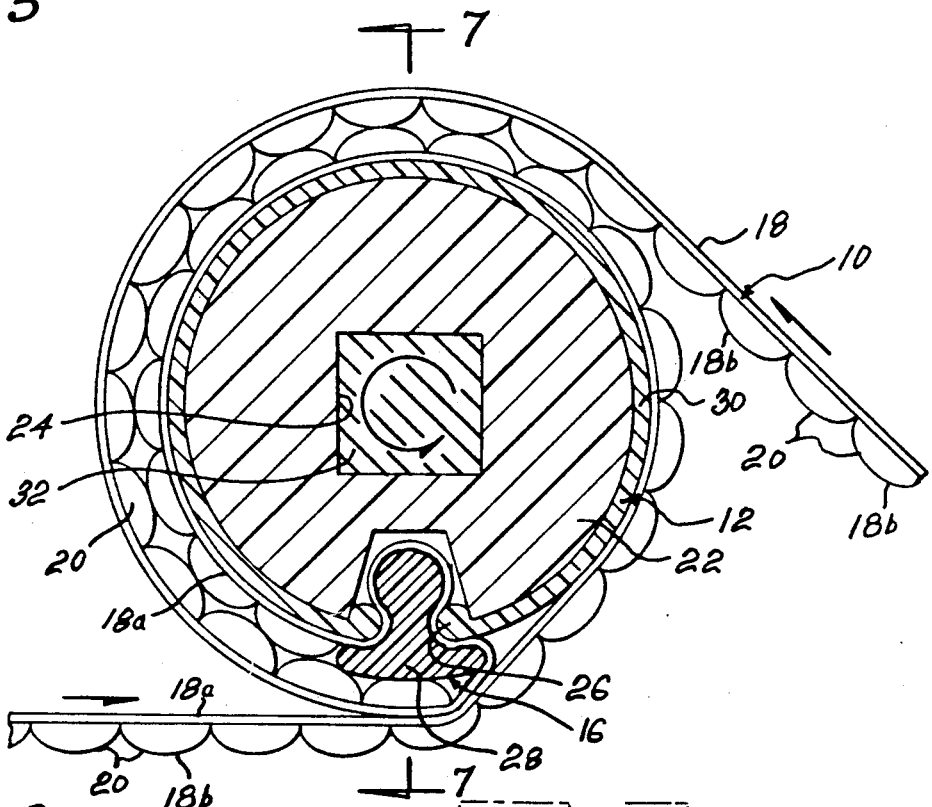
FIG. 6 is an axial cross-section, taken along line 6—6 of FIG. 7.
Figure 7:
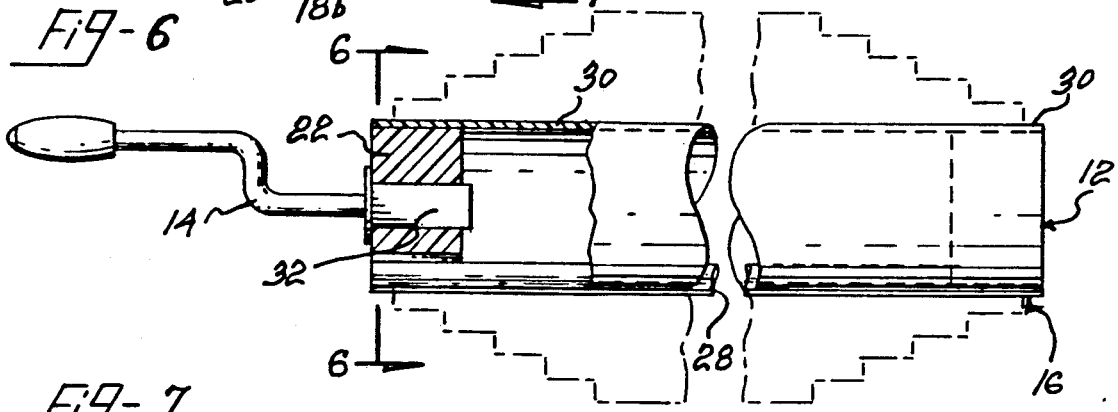
FIG. 7 is a fragmentary side elevation, partly in cross-section, of a detail of the present invention.
Figure 9:
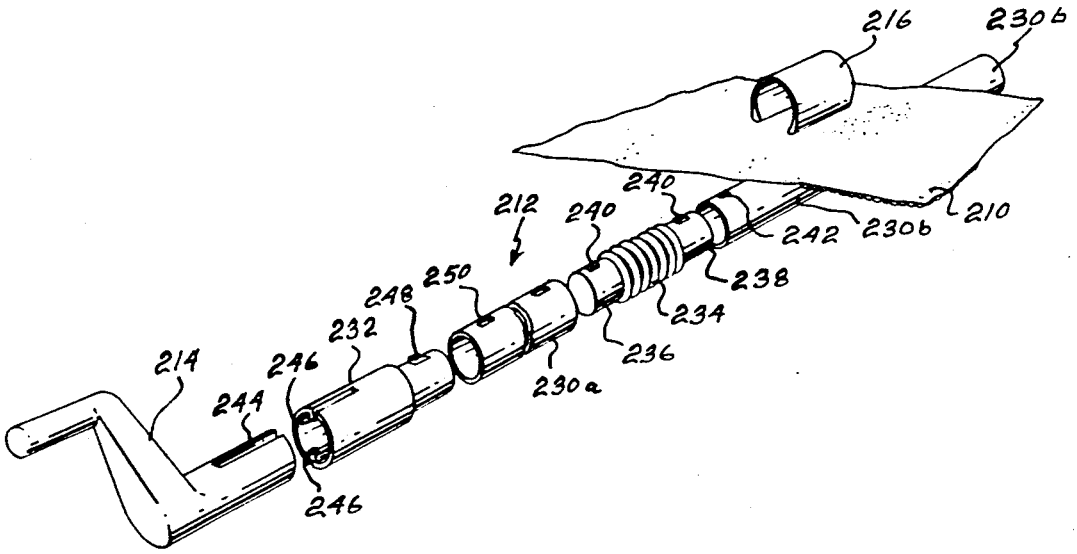
FIG. 9 is a fragmentary, exploded perspective view of a further embodiment of the present invention.
Figure 10:
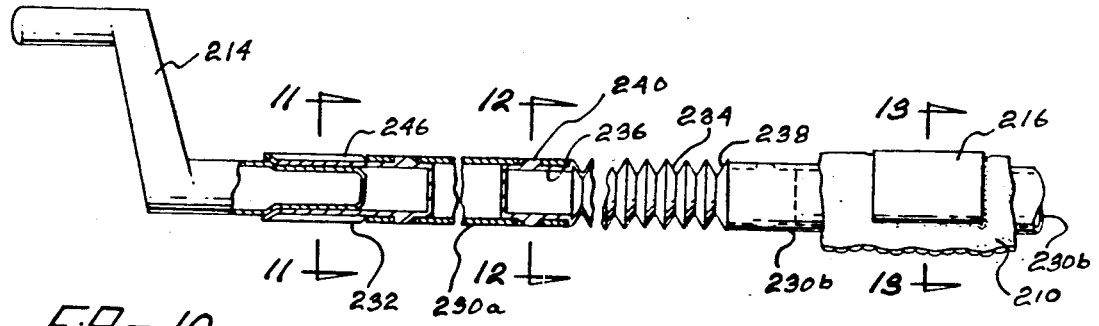
FIG. 10 is a fragmentary side elevation partly in cross section of the roll-up device according to the embodiment of FIG. 9.
Figure 11:
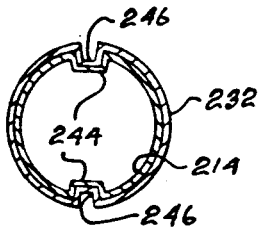
FIG. 11 is a vertical cross section taken along lines 11—11 of FIG. 10.
Figure 12:
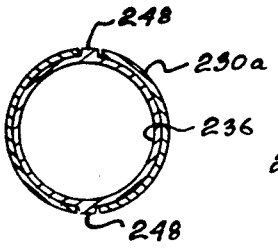
FIG. 12 is a vertical cross section taken along lines 12—12 of FIG. 10.
Figure 13:
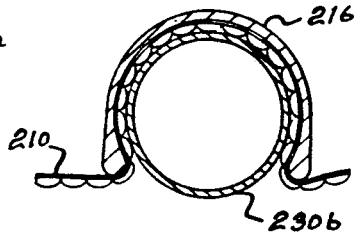
FIG. 13 is a vertical cross section taken along lines 13—13 of FIG. 10.

Referring now to FIGS. 5 through 7, there are shown the details of a first embodiment of the flexible shaft 12 and its attachment to the swimming pool cover 10. The swimming pool cover 10 includes a sheet 18*a* and a laminated sheet 18*b* of the conventional type used for swimming pools, with air pockets 20 formed between the laminated sheets 18*a* and 18*b* so as to provide both buoyancy to the cover 10 and insulation to the body of water W in the swimming pool P.

The shaft 12 in the embodiment of FIGS. 1 to 7 includes an extruded plastics hollow tube 30 in which is provided one or more cylindrical inserts 22 to give the tube 30 the necessary torsional strength. In the case of the end insert 22, a socket 24 for the crank handle 14 is provided.

In the embodiment shown in the FIGS. 5 to 7, an axial recess 24 is provided centrally of the end plug 22 into which a projection 32 on the end of the crank 14 can be mated. The cross-section of the projection 32 and the recess 24 in the present embodiment is shown as being square, but it could also be hexagonal or other polygonal cross-section.

The flexible shaft 12 can be of any construction as long as it has the characteristics of being at least relatively flexible and can transmit torque along its entire length. It has been contemplated, for instance, to use tubing such as presently used for swimming pool vacuum cleaner devices, a steel wire cable, or solid plastics extrusion. A combination of these various elements can also be used, or a thin wall aluminum tube, for instance, could also be utilized.

Figure 8:
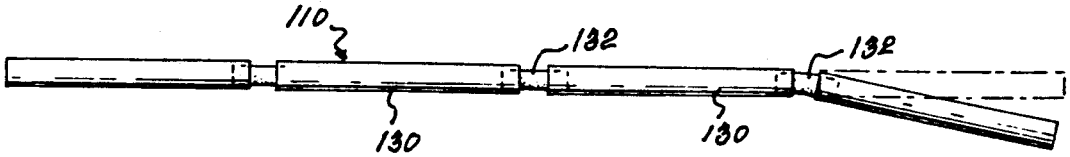
FIG. 8 is a fragmentary side elevation of another embodiment of a detail of the present invention.

It has also been contemplated to use, as shown in FIG. 8, a series of rigid modules or pipe members 130 coupled together by torque transmitting flexible members 132. Therefore, as shown in FIG. 8, a flexible shaft 110 can be made up of rigid tube segments 130 coupled by flexible coupling members 132 which could be made of a plastics material having proper torque transmitting properties.

Referring to the embodiment shown in FIGS. 5 to 7, the cover fastener 16 can be of any variety of shapes. Elongated pieces of an extruded plastic strip 28, are formed and are adapted to snap into an elongated recess 26 defined axially in the tube 30. The fastener 28 may be provided as a plurality of short pieces and inserted in the recess 26 in a spaced-apart manner along the length of the shaft 12. The advantage of the snap-in fastener 28 is that the cover 10 is not pierced but is merely folded into the recess 26.

However, it is also contemplated to use an anchor pin of sorts which actually pierces the cover 10 and is anchored in a suitable female recess along the length of the shaft 12. The important criterion is that the cover 10 be fastened at least intermittently along the entire length thereof.

Preferably, the shaft 12 is located intermediate two extremities of the cover 10. In the case of a circular cover, the shaft can extend diametrically of the cover 10. In the case of an oval cover or rectangular cover, the shaft 12 will preferably extend laterally across the width of the cover at its greatest width and preferably near the center of the longitudinal length thereof.

In the embodiment shown in FIG. 1, a pair of pull cords 38 and 40 are attached at opposite extremities of the cover 10 with the pull cords normal to the axis of the shaft 12.

Once the swimming pool cover has been rolled up on the shaft 12 by means of rotating the crank arm 14 inserted into the recess 24, it can be stored, in the case of an above-ground pool P, on storage hooks 36 on the side of the pool wall. In the case of a below-ground pool, the rolled-up cover can merely be lifted and stored along the edge of a patio or fence, etc. When it is required to deploy the swimming pool cover 10 on the water surface, the rolled-up swimming pool cover 10 and shaft are floated on the surface of the water, and the pull cords 38 and 40 are grasped simultaneously and tension is applied to cause the cover to be payed out from the shaft 12 and be properly deployed on the surface of the water W.

In a further embodiment of the shaft there is shown in FIGS. 9 to 13 shaft sections 230*a*, 230*b*, etc. which are joined by means of flexible couplings 234. Referring in details to these drawings a removable crank handle 214 is provided which has longitudinal diametrically opposed slots 244. The end of the handle 214, which defines the slots 244, is of a diameter such that it snugly fits into the end of the rigid coupling 232 which has male ribs 246 adapted to engage the slots 244 so as to transmit the torque provided on the handle through coupling. The hollow coupling 232 has a reduced diameter section on the other end thereof adapted to snugly fit into the end of a tube section 230*a*. Spring button 248 on the reduced diameter sleeve is adapted to engage in an opening 250 provided in the wall of the tube 230*a*.

Couplings 234 are of a hollow thermoplastic material having a corrugated section which provides the necessary flexibility while retaining torque transmission capabilities. The ends 236 and 238 of the couplings 234 likewise have spring buttons 240 adapted to engage in mating openings 242 provided near the ends of the hollow respective tube sections 230*a* and 230*b*. All of the parts making up the shaft can be either molded or at least the tube sections can be extruded of plastics material or the like. Couplings 234 can be blow molded and the spring buttons 240 may be hollow projections molded in the ends 236 and 238. The handle 214 may also be blow molded or injection molded.

The shaft tube sections 230*a* and 230*b* can be of varying lengths and a number of such sections can be coupled together by means of coupling tubes 234 depending on the size of the pool.

In one example, the tube sections 230*a* and 230*b* were extrusions made of styrene material. All the flexible couplings 234 were of ethylene vinyl acetate.

In order to attach the cover 210 to the shaft 212 a rigid spring clip 216 has been provided. The spring clip can be easily used for mounting or otherwise attaching the cover 210 to the shaft 212 shown in FIGS. 9, 10 and 13. The clip 216 may be formed with reinforcements beads near the edge thereof and will generally be of a high density polyethylene. The clip 216 could be extruded.

The embodiment shown in FIGS. 9 to 13 could be operated in the same manner as the embodiment shown in FIGS. 1 to 7. One is reminded that the snug fit of the male and female couplings provide for easily detaching the sections. Reliance is made on the spring buttons 250, 240 and 248. These spring buttons may have a slope surface if they are molded in the insert direction but must be depressed by fingers or tools in order to allow the pieces to be detached.

We claim:

1. A roll-up device for a swimming pool cover comprising an elongated flexible shaft having opposite ends which is attached to at least intermittent locations along its length to a floatable sheet material cover which substantially covers the water surface of a swimming pool, the shaft and the cover, otherwise unsupported, float on the water surface in a mode where the pool is protected by the cover, means at the one end of the shaft for connecting a manual, removable crank arm to the end of the shaft for applying torque to the shaft whereby the shaft can transmit torque to the cover through the entire length of the shaft, in order to roll the flexible cover on the shaft and whereby the shaft and rolled-up cover are removed from the water surface in a mode where the pool is uncovered and ready to use.

2. A combined swimming pool cover and unsupported roll-up device comprising a flexible floatable sheet material cover for substantially covering the water surface of a swimming pool or the like, and an elongated shaft having opposite ends extending laterally of the cover, means attaching said shaft at least at intermittent locations along its length to the sheet material cover such that the shaft and cover combination float on the water surface in a pool-covered mode and winding means removably connected into one end of the shaft suitable to transmit torque to the cover through the entire length of the shaft, the winding means including a manual crank arm and the shaft including means for receiving the crank arm in order to roll the flexible cover on the shaft and whereby the shaft and rolled-up cover can be removed from the water surface in a pool-uncovered mode.

3. A combined swimming pool cover and roll-up device as defined in claim 2, wherein the shaft is attached to the sheet material cover intermediate the cover extending laterally from one edge to an opposite edge thereof.

4. A flexible shaft as defined in claim 1, wherein the shaft is an elongated tubular member of flexible material provided at least with one insert having means for receiving the winding means and for transmitting the torque applied to the winding means through the length of the flexible tube forming the shaft.

5. A swimming pool cover and roll-up device as defined in claim 4, wherein the insert is provided with an axial recess of polygonal cross-section, and a winding means includes a manual crank arm having an end projection of a cross-section mating with the polygonal cross-section of the axial recess in the insert.

6. A swimming pool cover and roll-up device as defined in claim 2, wherein the attachment means includes a snap-in fastener adapted to mate with a female axial recess extending axially of the flexible shaft, and the fastener is adapted to fold in a portion of the swimming pool cover into the recess and lock the portion of the swimming pool cover therein for purposes of attaching the swimming pool cover to the elongated shaft.

7. A roll-up device as defined in claim 1, wherein the flexible shaft includes a series of rigid members connected end to end by means of flexible couplings capable of transmitting torque from one rigid member to the other.

8. A roll-up device as defined in claim 7, wherein the shaft is made up of a plurality of alternating elongated hollow rigid sections and couplings wherein each coupling is in the form of a blow molded hollow corrugated member having mating ends at each end thereof mating with the rigid shaft sections.

* * * * *